US008978598B2

(12) United States Patent
Iwai

(10) Patent No.: US 8,978,598 B2
(45) Date of Patent: Mar. 17, 2015

(54) SENSOR ABNORMALITY DETECTION APPARATUS AND A BLOCK HEATER INSTALLATION DETERMINING APPARATUS

(75) Inventor: Atsushi Iwai, Tajimi (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 0 days.

(21) Appl. No.: 13/390,766

(22) PCT Filed: Mar. 9, 2010

(86) PCT No.: PCT/JP2010/053903

§ 371 (c)(1),
(2), (4) Date: Feb. 16, 2012

(87) PCT Pub. No.: WO2011/111174

PCT Pub. Date: Sep. 15, 2011

(65) Prior Publication Data

US 2012/0318214 A1 Dec. 20, 2012

(51) Int. Cl.
*F01P 11/16* (2006.01)
*F02D 41/06* (2006.01)

(52) U.S. Cl.
CPC ..... *F01P 11/16* (2013.01); *F02D 41/064* (2013.01); *F01P 2025/08* (2013.01); *F01P 2031/00* (2013.01)
USPC ..... 123/41.15; 701/113

(58) Field of Classification Search
CPC ..... F01P 11/14; F01P 11/16; F01P 11/18; F02D 41/062; F02D 41/064; G01M 15/00; B60W 10/06
USPC ..... 123/41.15; 701/112, 113
See application file for complete search history.

(56) References Cited

U.S. PATENT DOCUMENTS 6,714,854 B2 * 3/2004 Linenberg et al. ..... 701/113
7,168,399 B2 * 1/2007 Wakahara ..... 123/41.15

(Continued)

FOREIGN PATENT DOCUMENTS

JP 2004-251186 9/2004
JP 2006-70782 3/2006

(Continued)

OTHER PUBLICATIONS

International Search Report in International Application No. PCT/JP2010/053903; Mailing Date: Apr. 27, 2010.

*Primary Examiner* — Lindsay Low
*Assistant Examiner* — Jacob Amick
(74) *Attorney, Agent, or Firm* — Finnegan, Henderson, Farabow, Garrett & Dunner, LLP

(57) ABSTRACT

A sensor abnormality detection apparatus which is installed in a vehicle with an electric water pump for circulating engine cooling water and is configured to perform an abnormality detecting process related to a first temperature sensor or a second temperature sensor based on a relationship between a detection result of the first temperature sensor for detecting a temperature of the engine cooling water and a detection result of the second temperature sensor for detecting a temperature of another medium which is correlated with the temperature of the engine cooling water or an estimation result of the temperature of the engine cooling water, comprising: a water pump forced-operating part configured to force the electric water pump to operate if the detection result of the first temperature sensor and the detection result of the second temperature sensor or the estimation result of the temperature of the engine cooling water do not meet a predetermined relationship, under a condition where the electric water pump is not operated after an engine starts.

5 Claims, 8 Drawing Sheets

(56) References Cited

U.S. PATENT DOCUMENTS

| | | | | |
|---|---|---|---|---|
| 2006/0093014 | A1 | 5/2006 | Higashiyama et al. | |
| 2008/0300774 | A1* | 12/2008 | Wakahara | 701/113 |
| 2009/0078033 | A1 | 3/2009 | Iwai | |
| 2009/0182489 | A1* | 7/2009 | Yang et al. | 701/113 |
| 2009/0319162 | A1* | 12/2009 | Bommer et al. | 701/113 |

FOREIGN PATENT DOCUMENTS

| | | |
|---|---|---|
| JP | 2006-125306 | 5/2006 |
| JP | 2008-14211 | 1/2008 |
| JP | 2008-298058 | 12/2008 |
| JP | 2008-298059 | 12/2008 |
| JP | 2008-303775 | 12/2008 |

* cited by examiner

SENSOR ABNORMALITY DETECTION APPARATUS AND A BLOCK HEATER INSTALLATION DETERMINING APPARATUS

CROSS-REFERENCE TO RELATED APPLICATIONS

This application is a national phase application of International Application No. PCT/JP2010/053903, filed Mar. 9, 2010, the contents of which are incorporated herein by reference.

TECHNICAL FIELD

The present invention is related to a sensor abnormality detection apparatus which is installed in a vehicle with an electric water pump for circulating engine cooling water, a block heater installation determining apparatus, etc.

BACKGROUND ART

JP2008-298058A discloses a controller of an engine which has a function of warming engine cooling water by energizing a block heater, which is installed on the engine, during an engine off period in cold climates, wherein a relationship between the presence or absence of energization of the block heater during the engine off period and a behavior of a temperature of a cooling medium immediately after the engine starts is utilized to determine whether there has been energization of the block heater during the engine off period. If it is determined that there has been energization of the block heater, an abnormality diagnosing process related to a cooling system is prevented or an abnormality diagnosing condition is changed.

However, in the case of a vehicle which includes an electric water pump for circulating engine cooling water, driving the electric water pump before the warming-up of the engine is not useful, except for a special situation, in terms of energy saving. On the other hand, if the electric water pump is not driven before the warming-up of the engine, the presence or absence of energization of the block heater cannot be determined with high accuracy, which leads to a problem that an abnormality detection of a cooling water temperature sensor, etc cannot be performed with high accuracy.

SUMMARY OF INVENTION

Therefore, it is an object of the present invention to provide a sensor abnormality detection apparatus, a block heater installation determining apparatus, etc., which can detect the presence or absence of energization of the block heater with high accuracy and use it for a sensor abnormality determination, while saving energy.

In order to achieve the aforementioned objects, according to the first aspect of the present invention, a sensor abnormality detection apparatus is provided which is installed in a vehicle with an electric water pump for circulating engine cooling water and is configured to perform an abnormality detecting process related to a first temperature sensor or a second temperature sensor based on a relationship between a detection result of the first temperature sensor for detecting a temperature of the engine cooling water and a detection result of the second temperature sensor for detecting a temperature of another medium which is correlated with the temperature of the engine cooling water or an estimation result of the temperature of the engine cooling water.

The sensor abnormality detection apparatus includes a water pump forced-operating part configured to force the electric water pump to operate if the detection result of the first temperature sensor and the detection result of the second temperature sensor or the estimation result of the temperature of the engine cooling water do not meet a predetermined relationship, under a condition where the electric water pump is not operated after an engine starts.

The sensor abnormality detection apparatus is configured such that if a decrease in the temperature of the engine cooling water is observed based on the detection result of the first temperature sensor after the forced-operation of the electric water pump by the water pump forced-operating part, the abnormality detecting process is prevented, an abnormality detection result is invalidated, or an abnormality detecting way of the abnormality detecting process is changed.

According to the present invention, it is possible to obtain a sensor abnormality detection apparatus, a block heater installation determining apparatus, etc., which can detect the presence or absence of energization of the block heater with high accuracy and use it for a sensor abnormality determination, while saving energy.

EXPLANATION FOR REFERENCE NUMBERS

Figure 1:
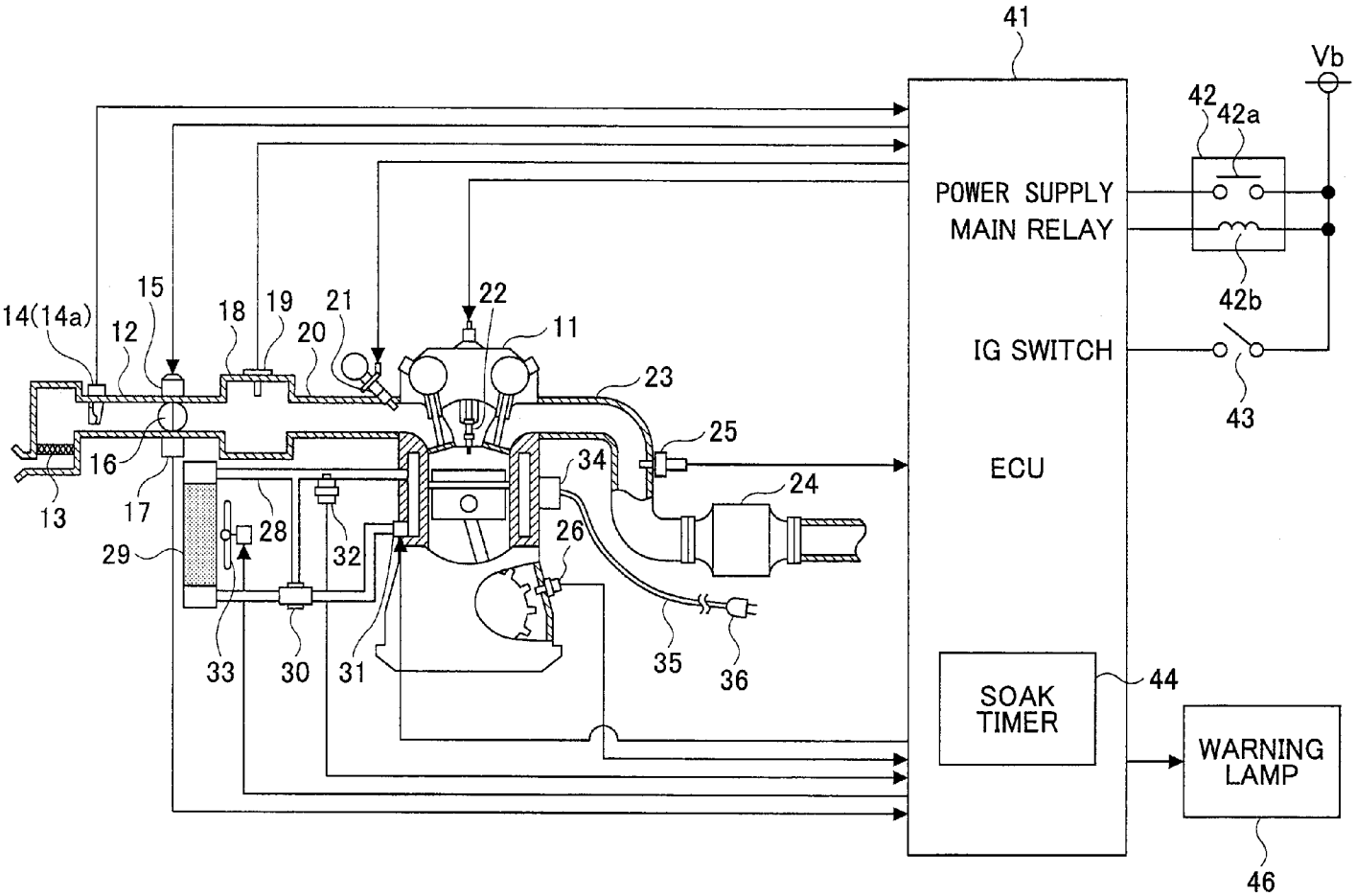
FIG. 1 is a diagram for schematically illustrating an engine control system as a whole according to an embodiment of the present invention.

11 engine
12 intake pipe
13 air cleaner
14 airflow meter
14*a* intake air temperature sensor
15 motor
16 throttle valve
17 throttle position sensor
18 surge tank
19 intake pipe pressure sensor
20 inlet manifold
21 fuel injection valve
22 spark plug
23 exhaust pipe
24 catalyst

25 exhaust gas sensor
26 crank angle sensor
28 cooling water circulating circuit
29 radiator
30 thermostat valve
31 electric water pump
32 cooling water temperature sensor
33 cooling fan
34 block heater
35 power cord
36 plug
41 ECU
42 main relay
42*a* relay contact
42*b* relay driving coil
43 IG switch
44 soak timer
46 warning lamp
50 sensor abnormality detection apparatus
52 sensor abnormality determining part
54 block heater determining part
60 block heater installation determining apparatus
70 controller of an electric water pump
72 W/P forced-operating part
74 W/P ordinary control part

BEST MODE FOR CARRYING OUT THE INVENTION

In the following, the best mode for carrying out the present invention will be described in detail by referring to the accompanying drawings.

FIG. 1 is a diagram for schematically illustrating an engine control system as a whole according to an embodiment of the present invention. An air cleaner 13 is provided at the most upstream point in an intake pipe 12 of an engine 11 (an internal combustion engine). An airflow meter 14 for detecting an intake air flow is provided downstream of the air cleaner 13. An intake air temperature sensor 14*a* for detecting an intake air temperature (an outside air temperature) is provided in the airflow meter 14. It is noted that the airflow meter 14 may be a hot wire type or hot film type of an airflow meter which incorporates the intake air temperature sensor 14*a* therein. A throttle valve 16 whose position is adjusted by a motor 15 and a throttle position sensor 17 for detecting the position of the throttle valve 16 (i.e., a throttle position) are provided downstream of the airflow meter 14.

A surge tank 18 is provided downstream of the throttle valve 16. An intake pipe pressure sensor 19 for detecting an intake pipe pressure is provided in the surge tank 18. Further, inlet manifolds 20 for introducing air into the respective cylinders of the engine 11 are connected to the surge tank 18. Fuel injection valves 21 for injecting fuel are attached near intake ports of the inlet manifold 20. Further, spark plugs 22 are attached to cylinder heads of the engine 11 on a cylinder basis, and air fuel mixture in the cylinders is ignited by electric arcs from the respective spark plugs 22.

A catalyst 24 for catalytically clearing CO, HC, NOx, etc., in exhaust gas, such as a three way catalyst, is provided in an exhaust pipe 23 (an exhaust passage). An exhaust gas sensor 25 for detecting an air/fuel ratio of the exhaust gas or rich/lean, etc., is provided upstream of the catalyst 24. Further, a crank angle sensor 26 for outputting pulse signals when a crank shaft is rotated a predetermined crank angle is attached to the engine 11. A crank angle and an engine rotational speed are detected based on the output signal of the crank angle sensor 26.

A cooling water circulating circuit 28 is provided in which cooling water of the engine 11 is circulated. A radiator 29 for radiating heat of the cooling water, a thermostat valve 30 for controlling flow rate of the cooling water circulating to the radiator 29, and an electric water pump 31 for circulating the cooling water are provided in the cooling water circulating circuit 28. The electric water pump 31 is supplied with power from an on-vehicle battery (not shown). Further, a cooling water temperature sensor 32 is provided near an outlet of the cooling water of the engine 11 in the cooling water circulating circuit 28. The cooling water temperature sensor 32 detects a temperature of the cooling water (i.e., a circulating water temperature) which flows from the engine 11 to the cooling water circulating circuit 28. It is noted that the cooling water temperature sensor 32 may be provided at any location as long as it can detect the temperature of the cooling water of the engine 11. Further, a cooling fan 33 for performing forced cooling of the cooling water is provided behind the radiator 29.

A block heater 34 for freeze proofing is provided on a cylinder block of the engine 11. The block heater 34 has a power cord 35 connected thereto. During the engine off period in cold climates, a user may prevent the cooling water of the engine 11 from freezing by inserting a plug 36 of the power cord 35 of the block heater 34 into a convenience receptacle (not shown), which is an external power supply, to energize the block heater 34. Before starting the engine 11, the user removes the plug 36 of the power cord 35 from the convenience receptacle and stores it at any appropriate location in an engine room.

It is noted that since, except for cold climates, it is not necessary to warm the cooling water with the block heater 34, the power cord 35 of the block heater 34 is kept in the engine room even during the engine off period and thus the block heater 34 is not energized.

The output signals of the various sensors such as the cooling water temperature sensor 32 are input to an electronic control unit (referred to as an ECU, hereinafter) 41. To a power supply terminal of the ECU 41 is applied power supply voltage Vb from the on-vehicle battery (not shown) via a main relay 42. A relay driving coil 42*b* for driving a relay contact 42*a* of the main relay 42 is connected to a main relay control terminal of the ECU 41. The ECU 41, etc., are supplied with the power supply voltage when the relay contact 42*a* is turned on by energizing the relay driving coil 42*b*. The power supply to the ECU 41, etc., is stopped when the relay contact 42*a* is turned off by stopping energizing the relay driving coil 42*b*.

An on/off signal of an ignition switch (referred to as an IG switch, hereinafter) 43 is input to an IG switch terminal of the ECU 41. When the IG switch 43 is turned on, the main relay 42 is turned on and thus the power supply to the ECU 41, etc., is initiated. When the IG switch 43 is turned off, the main relay 42 is turned off and thus the power supply to the ECU 41, etc., is stopped.

A soak timer 44, which is powered from a backup power supply (not shown) to perform a timer operation, is incorporated in the ECU 41. The soak timer 44 starts the timer operation after the engine stop (for example, after the IG switch 43 is turned off) to measure an elapsed time after the engine stop.

The ECU 41 is configured to mainly include a microprocessor that includes a CPU, a ROM in which control programs are stored, a RAM in which calculation results are stored, a timer, a counter, an input interface, an output interface, etc., for example. The ECU 41 implements control of an injection quantity with the injection valves 21 and an ignition timing with the spark plugs 22 by the CPU executing various engine control programs stored in the ROM.

Further, as described in detail hereinafter, the ECU 41 implements respective embodiments of a sensor abnormality detection apparatus 50, block heater installation determining apparatus 60 and a controller 70 of the electric water pump 31 by the CPU executing various programs stored in the ROM.

Figure 2:
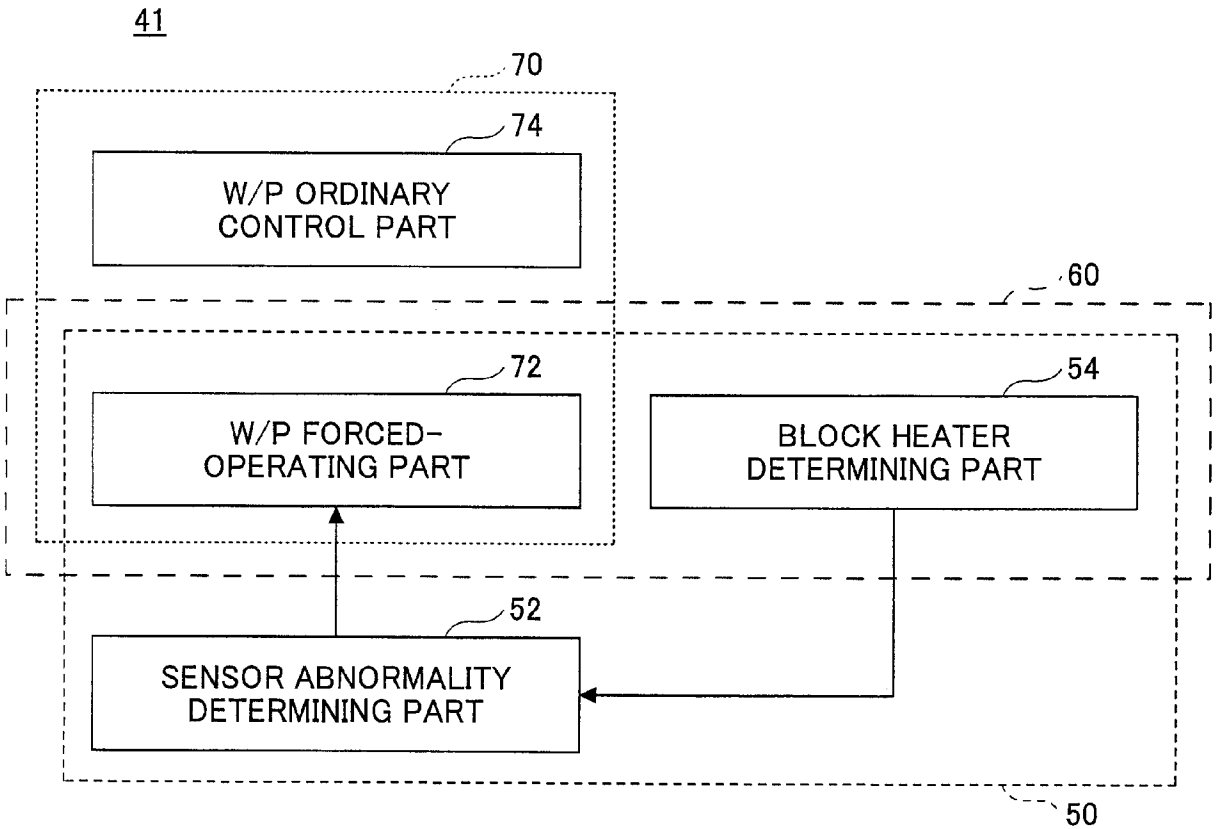
FIG. 2 is a function diagram for illustrating a main functional part of an ECU 41 related to an abnormality detection.

FIG. 2 is a function diagram for illustrating a main functional part of the ECU 41 related to a sensor abnormality detecting process.

The ECU 41 includes a sensor abnormality determining part 52, a block heater determining part 54, a W/P forced-operating part 72 for forcing the electric water pump 31 to operate and a W/P ordinary control part 74 for performing ordinary control of the electric water pump 31, as shown in FIG. 2.

The sensor abnormality determining part 52, the block heater determining part 54 and the W/P forced-operating part 72 implement an embodiment of the sensor abnormality detection apparatus 50 in cooperation. Further, the block heater determining part 54 and the W/P forced-operating part 72 implement an embodiment of the block heater installation determining apparatus 60 in cooperation. Further, the W/P forced-operating part 72 and the W/P ordinary control part 74 implement an embodiment of the controller 70 of the electric water pump in cooperation. Hereinafter, the functions of the respective parts are described in detail.

Figure 3:
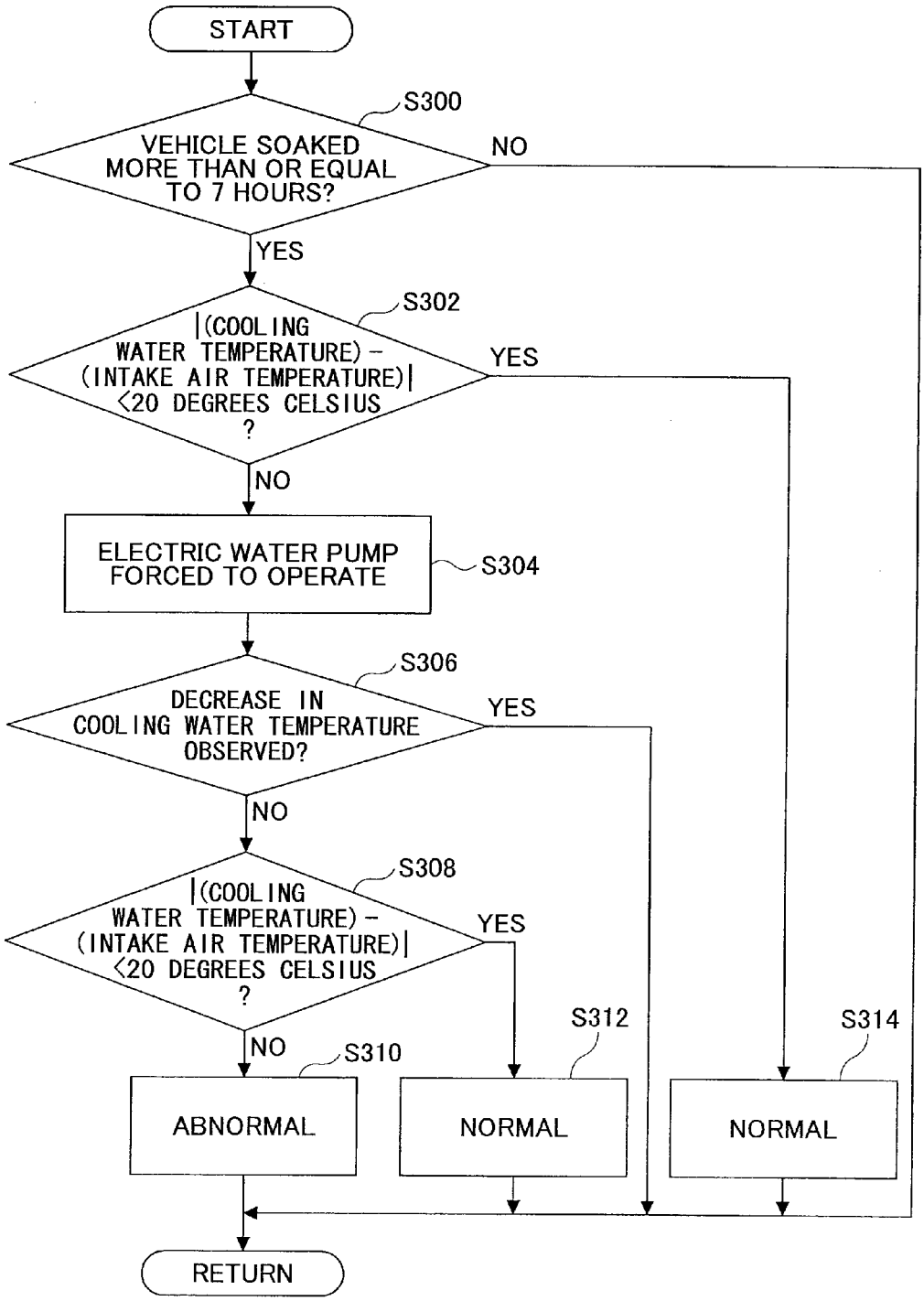
FIG. 3 is a flowchart for showing an example of a main process executed by a sensor abnormality detecting apparatus 50 according to the embodiment.

FIG. 3 is a flowchart for showing an example of a main process executed by the sensor abnormality detecting apparatus 50 according to the embodiment. The process routine shown in FIG. 3 is started at the time of starting the engine (at the time of warming-up).

In step 300, the sensor abnormality determining part 52 determines whether the vehicle has been soaked more than or equal to 7 hours based on the information from the soak timer 44. In other words, it is determined whether the engine off state has been maintained more than or equal to 7 hours after the engine was turned off. If it is determined that the vehicle has been soaked with engine off more than or equal to 7 hours, the process routine goes to step 302. On the other hand, if it is determined that the vehicle has not been soaked more than or equal to 7 hours (i.e., the vehicle has been soaked less than 7 hours), the process routine ends without performing any further process, determining that it is not possible to perform the sensor abnormality determination with high accuracy at this time of the engine start.

Figure 4:
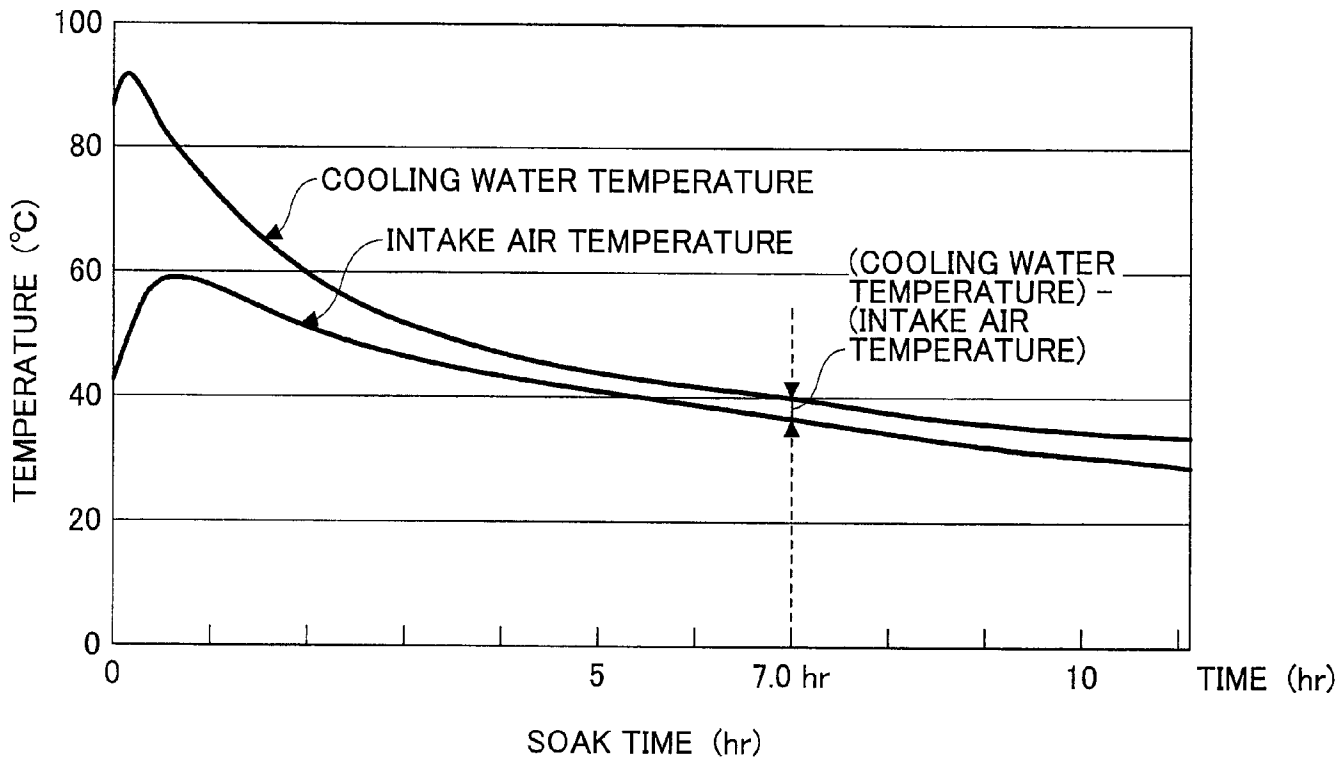
FIG. 4 is a graph which shows a relationship between a soak time, a cooling water temperature and an intake air temperature.

In step 302, the sensor abnormality determining part 52 determines whether an absolute value of a difference between the cooling water temperature and the intake air temperature (=the cooling water temperature−the intake air temperature) is smaller than 20 degrees Celsius based on the latest detection results of the intake air temperature sensor 14*a* and the cooling water temperature sensor 32. This is because the difference between the cooling water temperature and the intake air temperature converges to be smaller than or equal to a predetermined temperature (20 degrees Celsius, in this example) when the soak time exceeds a certain time (7 hours, in this example), as shown in FIG. 4. It is noted that the 7 hours and the 20 degrees Celsius are merely examples and appropriate values may be changed depending on vehicle types. Thus, the values may be determined by deriving the correlation as shown in FIG. 4 by experiment, etc.

In this step 302, if the absolute value of the difference between the cooling water temperature and the intake air temperature is smaller than 20 degrees Celsius, the process routine goes to step 314. On the other hand, if the absolute value of the difference between the cooling water temperature and the intake air temperature is greater than or equal to 20 degrees Celsius, the process routine goes to step 304.

In step 304, the W/P forced-operating part 72 forces the electric water pump 31 to operate. Then, the electric water pump 31 operates and thus the cooling water of the engine 11 begins to circulate in the cooling water circulating circuit 28.

In step 306, the block heater determining part 54 monitors the detection result of the cooling water temperature sensor 32 after the electric water pump 31 is forced to operate in step 304, and determines whether a decrease in the temperature of the cooling water is observed after the electric water pump 31 is forced to operate in step 304.

Figure 5:
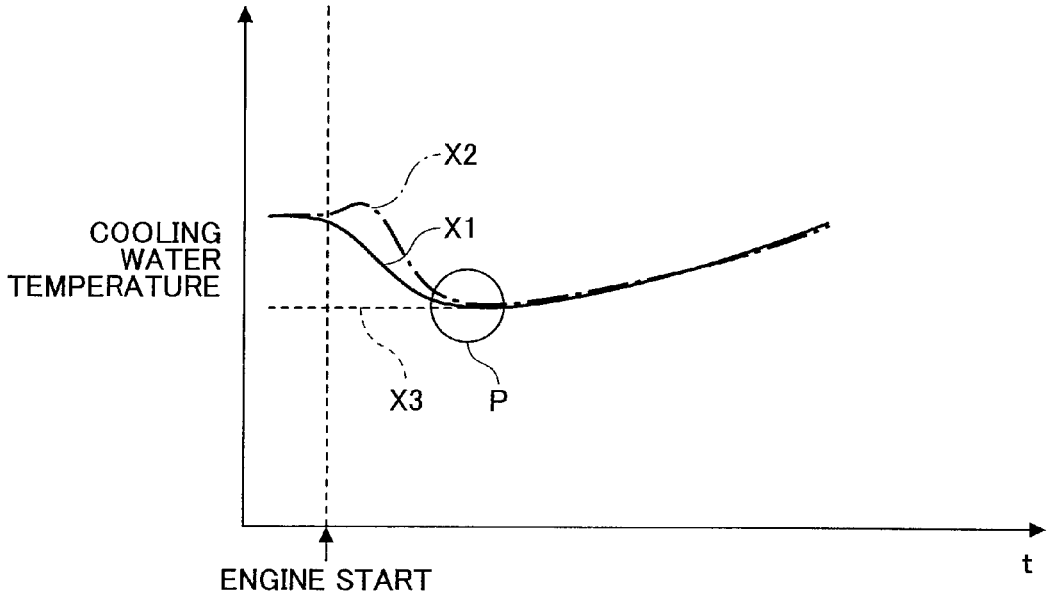
FIG. 5 is a diagram for schematically illustrating several examples of a variation pattern of the cooling water temperature after the engine starts according to the presence or absence of energization of the block heater.

Here, during the engine off period, the circulation of the cooling water in the cooling water circulating circuit 28 is stopped. Thus, if the block heater 34 is energized during the engine off period, the cooling water in the cylinder block of the engine 11 which is close to the block heater 34, compared to the rest of the cooling water in cooling water circulating circuit 28, is sufficiently heated by the heat transferred from the block heater 34 and thus has a relatively high temperature. On the other hand, the cooling water on a side of the radiator 29 which is farther side with respect to the block heater 34 is difficult to be heated by the heat from the block heater 34. For this reason, the temperature of the cooling water on the side of the radiator 29 tends to be substantially lower than that of the cooling water on the side of the engine 11. Consequently, when the cooling water begins to circulate in the cooling water circulating circuit 28, the warmed cooling water in the engine 11 flows out to the side of the radiator 29 and the cooled cooling water on the side of the radiator 29 flows into the engine 11 such that they change places. Thus, if the block heater 34 is energized during the engine off period, such a phenomenon occurs in which the cooling water temperature in the engine 11 (detected values of the cooling water temperature sensor 32) considerably decreases immediately after the engine starts, as indicated by lines X1 and X2 in FIG. 5. It is noted that in FIG. 5, the lines X1 and X2 indicate examples of variation patterns of the cooling water temperature (i.e., the detected values of the cooling water temperature sensor 32) if there has been energization of the block heater 34, while a line X3 indicates the cooling water temperature (i.e., the detected values of the cooling water temperature sensor 32) if there has been no energization of the block heater 34 or there is no block heater attached. It is noted that as indicated by the lines X1 and X2, depending on a vehicle type (i.e., locations of the cooling water temperature sensor 32 and the block heater 34, etc), in some cases the detected values of the cooling water temperature sensor 32 tend to decrease after it increases temporarily, while in other cases, the detected values of the cooling water temperature sensor 32 tend to decrease directly. In any case, by observing such a decrease in the cooling water temperature, it is possible to determine the presence or absence of energization of the block heater 34 with high accuracy.

In this step 306, if the decrease in the cooling water temperature is observed, the process routine ends without performing any further process, determining that it is not possible to perform the sensor abnormality determination with high accuracy at this time of the engine start because the block heater has been energized during the engine off period. On the other hand, if the decrease in the cooling water temperature is not observed, the process routine goes to step 308.

In step 308, the sensor abnormality determining part 52 determines again whether the absolute value of a difference between the cooling water temperature and the intake air temperature is smaller than 20 degrees Celsius based on the latest detection results of the intake air temperature sensor

14*a* and the cooling water sensor 32. In this step 308, if the absolute value of the difference between the cooling water temperature and the intake air temperature is smaller than 20 degrees Celsius, the process routine goes to step 312. On the other hand, if the absolute value of the difference between the cooling water temperature and the intake air temperature is greater than or equal to 20 degrees Celsius, the process routine goes to step 310.

In step 310, the sensor abnormality determining part 52 generates and outputs a determination result which indicates that at least one of the intake air temperature sensor 14*a* and the cooling water temperature sensor 32 is abnormal. In this case, the sensor abnormality determining part 52 warns the driver by turning on a warning lamp 46 provided in the instrument panel on the side of the driver seat or displaying a warning in a warning display portion, stores the abnormality information (abnormality codes) in a predetermined memory of the ECU 41, and ends the process routine.

In step 312 and 314, the sensor abnormality determining part 52 generates and outputs a determination result which indicates that the intake air temperature sensor 14*a* and the cooling water temperature sensor 32 are normal.

In this way, according to the sensor abnormality detecting process shown in FIG. 3, only if the relationship between the cooling water temperature and the intake air temperature indicates an abnormality or indicates a possibility of an abnormality at the time of the engine start (at the time of warming-up), the electric water pump 31 is forced to be driven. Thus, it is possible to detect the presence or absence of energization of the block heater 34 with high accuracy and use the detection results for a sensor abnormality determination, while saving energy in comparison with a configuration where the electric water pump 31 is always driven at the time of the engine start.

It is noted that according to the sensor abnormality detecting process shown in FIG. 3, a criterion of the determination in step 302 is the same as a criterion of the determination in step 308; however, these criteria may be different. For example, the criterion of the determination in step 302 may be stricter than the criterion of the determination in step 308. As an example, the criterion of the determination in step 302 may be whether the absolute value of the difference between the cooling water temperature and the intake air temperature is smaller than 15 degrees Celsius.

Figure 6:
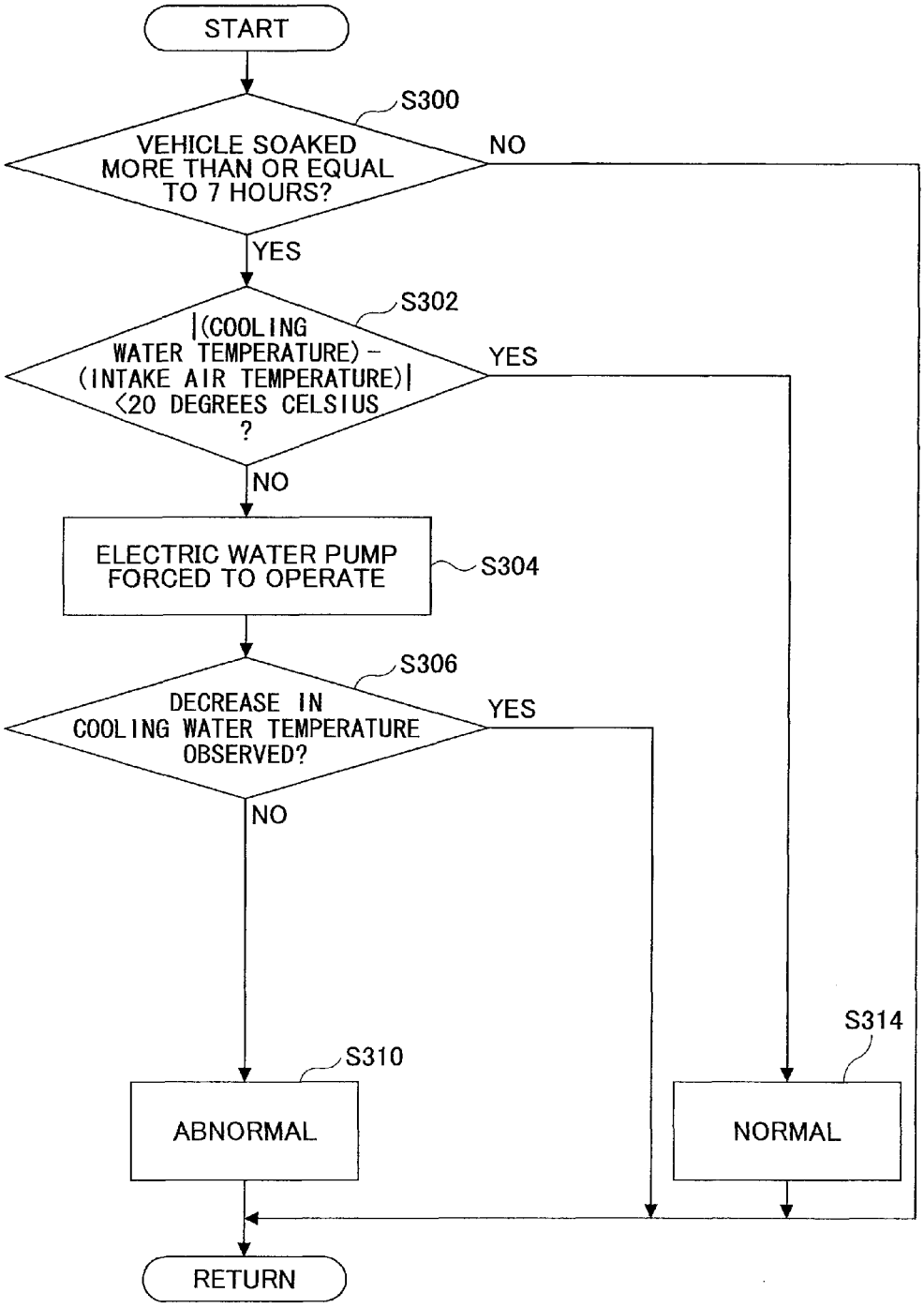
FIG. 6 is a flowchart for showing another example of the main process executed by a sensor abnormality detecting apparatus 50 according to the embodiment.

FIG. 6 is a flowchart for showing another example of the main process executed by the sensor abnormality detecting apparatus 50 according to the embodiment. The process routine shown in FIG. 6 is started at the time of starting the engine (at the time of warming-up). With respect to the process routine shown in FIG. 6, the processes which may be the same as those shown in FIG. 3 are given the same step numbers and are not explained. The sensor abnormality detecting process shown in FIG. 6 differs from the sensor abnormality detecting process shown in FIG. 3 in that it doesn't have the processes of step 308 and step 312. Specifically, according to the sensor abnormality detecting process shown in FIG. 3, the presence or absence of energization of the block heater 34 is reflected on the sensor abnormality determination by performing a final sensor abnormality determining process of step 308 if there has been no energization of the block heater 34 while preventing the final sensor abnormality determining process of step 308 if there has been energization of the block heater 34. To the contrary, according to the sensor abnormality detecting process shown in FIG. 6, the presence or absence of energization of the block heater 34 is reflected on the sensor abnormality determination by validating the abnormality determination result of step 302 if there has been no energization of the block heater 34 while invalidating the abnormality determination result of step 302 if there has been energization of the block heater 34.

Similarly, according to the sensor abnormality detecting process shown in FIG. 6, only if the relationship between the cooling water temperature and the intake air temperature indicates an abnormality or indicates a possibility of an abnormality at the time of the engine start, the electric water pump 31 is forced to be driven. Thus, it is possible to detect the presence or absence of energization of the block heater 34 with high accuracy and use the detection results for a sensor abnormality determination, while saving energy in comparison with a configuration where the electric water pump 31 is always driven at the time of the engine start.

Figure 7:
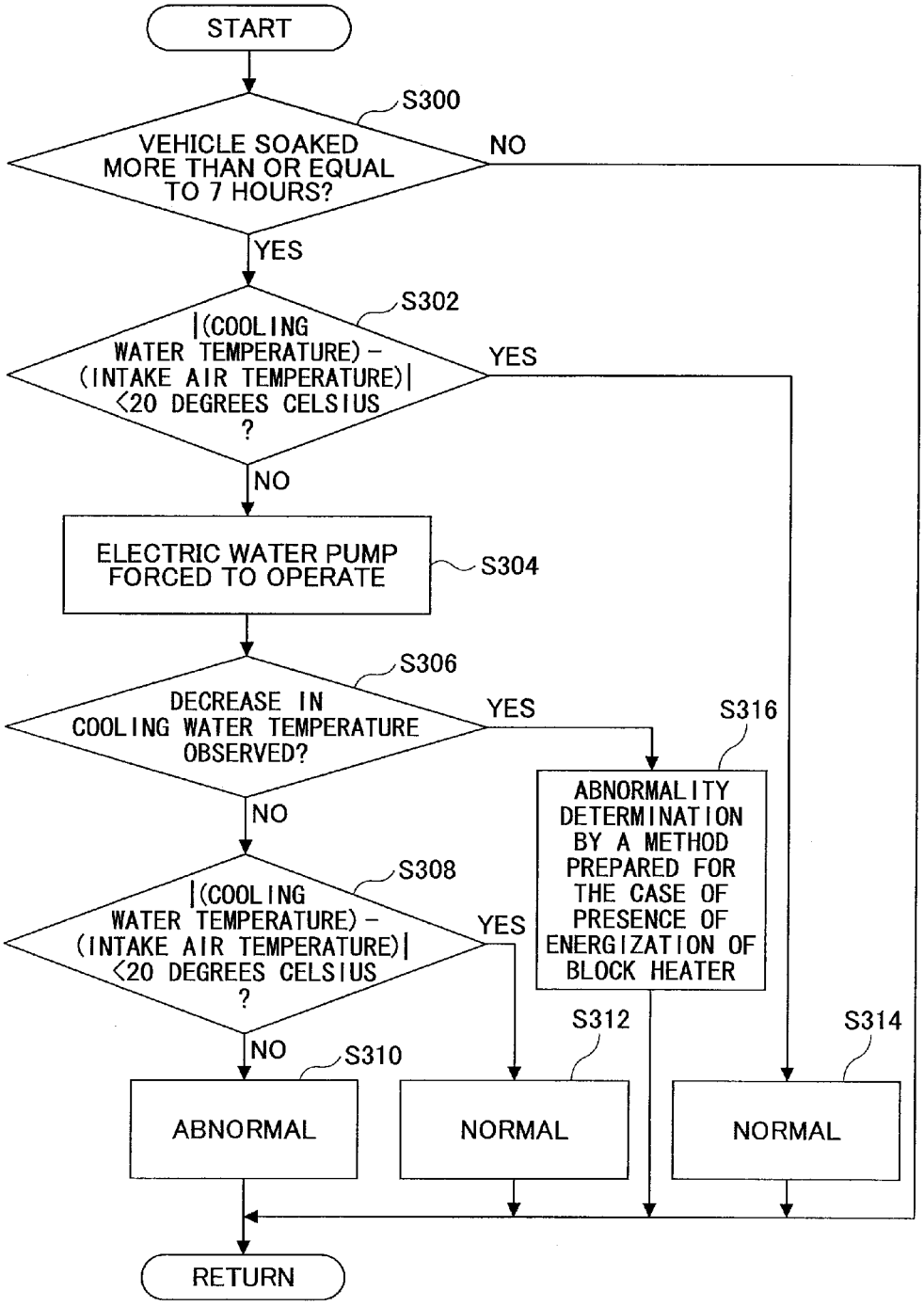
FIG. 7 is a flowchart for showing yet another example of the main process executed by a sensor abnormality detecting apparatus 50 according to the embodiment.

FIG. 7 is a flowchart for showing yet another example of the main process executed by a sensor abnormality detecting apparatus 50 according to the embodiment. The process routine shown in FIG. 7 is started at the time of starting the engine (at the time of warming-up). With respect to the process routine shown in FIG. 7, the processes which may be the same as those shown in FIG. 3 are given the same step numbers and are not explained. The sensor abnormality detecting process shown in FIG. 7 differs from the sensor abnormality detecting process shown in FIG. 3 in that a process of step 316 is added. Specifically, according to the sensor abnormality detecting process shown in FIG. 3, the final sensor abnormality determining process of step 308 is prevented if there has been energization of the block heater 34. To the contrary, according to the sensor abnormality detecting process shown in FIG. 6, a sensor abnormality determining process is performed by using another special abnormality determining way if there has been energization of the block heater 34.

More specifically, in step 306, if the decrease in the cooling water temperature is not observed, the process routine goes to step 316 in which a sensor abnormality determining process, which is prepared for the case where there has been energization of the block heater 34, is performed. The way of this sensor abnormality determining process may be arbitrary as long as the fact that there has been energization of the block heater 34 is taken into account. For example, a temperature near the lowest value of the cooling water temperature (see a portion P in FIG. 5) after the electric water pump 31 is forced to be driven may be detected by the cooling water temperature sensor 32, and it may be determined whether an absolute value of a difference between the detected temperature and the intake air temperature is smaller than 20 degrees Celsius. Alternatively, the determination threshold (20 degrees Celsius in this example) may be corrected (changed) by considering the effect due to the energization of the block heater 34.

Similarly, according to the sensor abnormality detecting process shown in FIG. 7, only if the relationship between the cooling water temperature and the intake air temperature indicates an abnormality or indicates a possibility of an abnormality at the time of the engine start, the electric water pump 31 is forced to be driven. Thus, it is possible to detect the presence or absence of energization of the block heater 34 with high accuracy and use the detection results for a sensor abnormality determination, while saving energy in comparison with a configuration where the electric water pump 31 is always driven at the time of the engine start.

It is noted that also in the sensor abnormality detecting process shown in FIG. 7, the processes of step 308 and step 312 may be omitted as is the case with the sensor abnormality detecting process shown in FIG. 6.

Figure 8:
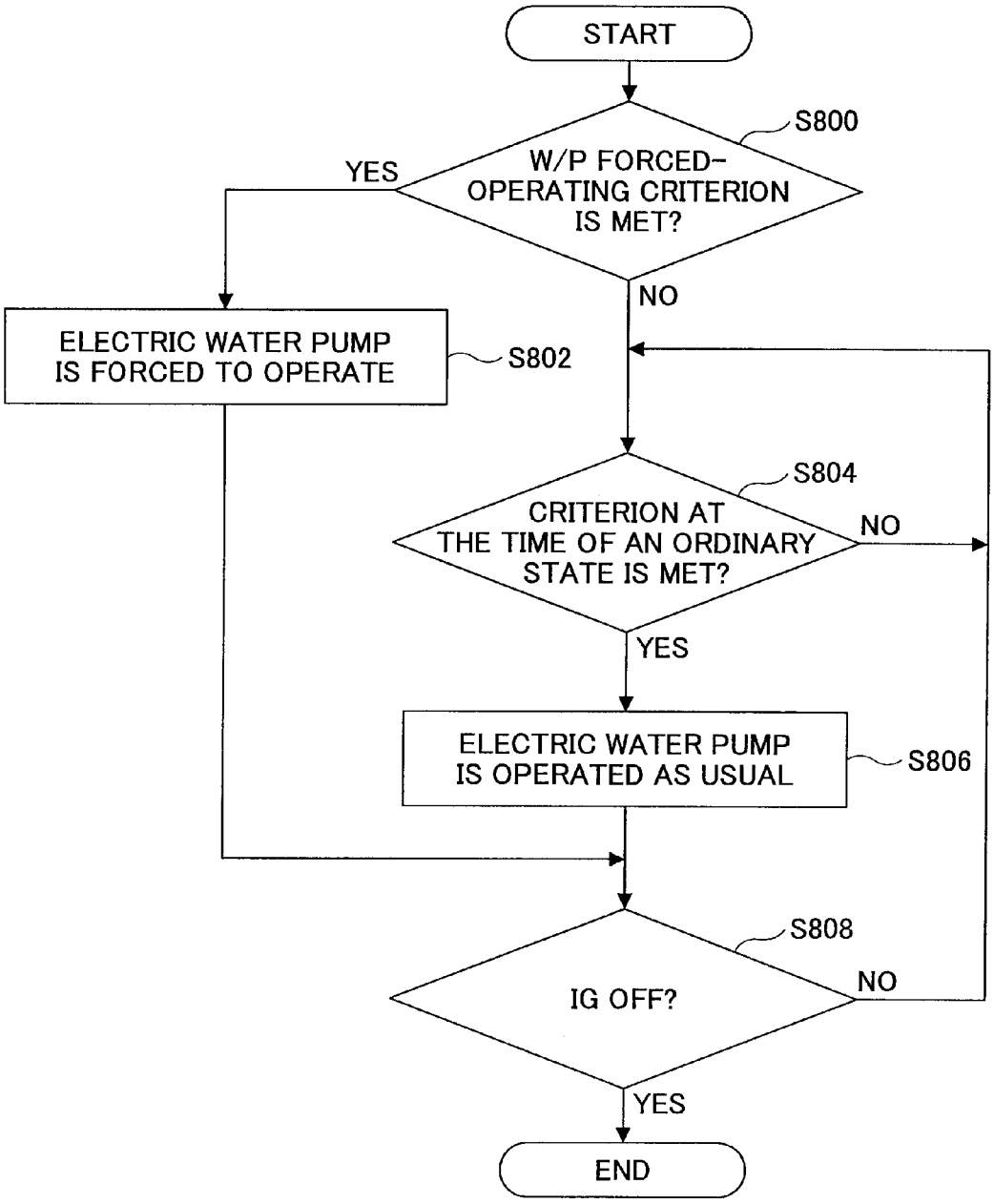
FIG. 8 is a flowchart for showing an example of a main process executed by a controller 70 of an electric water pump according to the embodiment.

FIG. 8 is a flowchart for showing an example of a main process executed by the controller 70 of the electric water pump according to the embodiment. The process routine shown in FIG. 8 is started at the time of starting the engine (at the time of ignition on). The process routine shown in FIG. 8 is performed concurrently with the sensor abnormality detecting process shown in FIG. 3, etc., immediately after the engine starts.

In step 800, the W/P forced-operating part determines whether a criterion (a W/P forced-operating criterion), which is necessary to be met in order to force the electric water pump 31 to operate, is met. As described above, the criterion, which is necessary to be met in order to force the electric water pump 31 to operate, is met if the absolute value of the difference between the cooling water temperature and the intake air temperature is greater than or equal to 20 degrees Celsius, for example, and it is reported by the sensor abnormality determining part 52. If the criterion, which is necessary to be met in order to force the electric water pump 31 to operate, is met, the process routine goes to step 802. On the other hand, the criterion, which is necessary to be met in order to force the electric water pump 31 to operate, is not met, the process routine goes to step 804.

In step 802, the W/P forced-operating part 72 forces the electric water pump 31 to operate (see the process described in connection with step 304). Then, the electric water pump 31 operates and thus the cooling water of the engine 11 begins to circulate in the cooling water circulating circuit 28.

In step 804, the W/P ordinary control part 74 determines whether a criterion at the time of an ordinary state, which is necessary to be met in order to operate the electric water pump 31, is met. The criterion at the time of an ordinary state may be arbitrary as long as it is not such a criterion which is always met after the engine starts. For example, the criterion at the time of an ordinary state may be met at the time when the warming-up of the engine is completed. The criterion at the time of an ordinary state may be defined by plural parameters such as a vehicle speed, the number of revolutions of the engine, an intake air flow, an intake air temperature, a cooling water temperature, etc. Further, the criterion at the time of an ordinary state may also be met when the cooling water temperature sensor 32 fails. In step 804, if the criterion at the time of an ordinary state is met, the process routine goes to step 806.

In step 806, the W/P ordinary control part 74 operates the electric water pump 31 according to a demand of a flow rate which is determined appropriately (i.e., performs an ordinary control). The ordinary control is performed continuously until the ignition switch is turned off (a affirmative determination of step 808).

The present invention is disclosed with reference to the preferred embodiments. However, it should be understood that the present invention is not limited to the above-described embodiments, and variations and modifications may be made without departing from the scope of the present invention.

For example, in the embodiment described above, the sensor abnormality determination is performed by evaluating the absolute value of a difference between the cooling water temperature and the intake air temperature at the time of the engine start, utilizing the fact that there is a correlation between the cooling water temperature of the engine and the intake air temperature; however, a temperature of another medium which is correlated with the cooling water temperature may be used instead of the intake air temperature. For example, instead of the detection results of the intake air temperature sensor 14*a*, detection results of an engine oil temperature sensor which detects the engine oil temperature may be used in a similar manner. Further, instead of the detection results of the intake air temperature sensor 14*a*, detection results of a transmission oil temperature sensor which detects the transmission oil temperature may be used in a similar manner. Further, instead of the detection results of the intake air temperature sensor 14*a*, detection results of an outdoor air temperature sensor which detects the outdoor air temperature may be used in a similar manner. Further, the relationship between these various temperatures and the cooling water temperature of the engine may be evaluated in a comprehensive manner.

Further, in the embodiment described above, the presence or absence of an abnormality of the cooling water temperature sensor 32 may be determined by evaluating the relationship between the cooling water temperature of the engine and its estimated value (expectation value). In this case, the estimated value may be derived by using the temperature of another medium which is correlated with the cooling water temperature, such as detection results of the intake air temperature sensor 14*a*. Alternatively, the estimated value may be derived by using the detection results of the cooling water temperature sensor 32 during the soak period, which are obtained at the time of self-initiating, etc.

Further, in the embodiment described above, the determination result, which indicates that at least one of the intake air temperature sensor 14*a* and the cooling water temperature sensor 32 is abnormal, is generated; however, other information, etc., may be used to further identify the abnormal subject.

The invention claimed is:

1. A sensor abnormality detection apparatus which is installed in a vehicle with an electric water pump for circulating engine cooling water and is configured to perform an abnormality detecting process related to a first temperature sensor or a second temperature sensor based on a relationship between a detection result of the first temperature sensor for detecting a temperature of the engine cooling water and a detection result of the second temperature sensor for detecting a temperature of another medium which is correlated with the temperature of the engine cooling water or an estimation result of the temperature of the engine cooling water, comprising:

a water pump forced-operating part configured to force the electric water pump to operate if the detection result of the first temperature sensor and the detection result of the second temperature sensor or the estimation result of the temperature of the engine cooling water do not meet a predetermined relationship, under a condition where the electric water pump would not otherwise operate when the vehicle is powered up, wherein if a decrease in the temperature of the engine cooling water is observed based on the detection result of the first temperature sensor after the forced-operation of the electric water pump by the water pump forced-operating part, the abnormality detecting process is prevented, an abnormality detection result is invalidated, or an abnormality detecting way of the abnormality detecting process is changed.

2. The sensor abnormality detection apparatus of claim 1, wherein if the decrease in the temperature of the engine cooling water is not observed based on the detection result of the first temperature sensor after the forced-operation of the electric water pump by the water pump forced-operating part, the abnormality detecting process is performed again or an abnormality detection result is validated.

3. The sensor abnormality detection apparatus of claim 1 which is configured to perform the abnormality detecting process related to the first temperature sensor or the second temperature sensor based on the relationship between the detection result of the first temperature sensor and the detection result of the second temperature sensor, wherein if the detection result of the first temperature sensor and the detection result of the second temperature sensor do not meet the predetermined relationship, a detection result is generated indicating that at least one of the first and second temperature sensors is abnormal, and if the detection result of the first temperature sensor and the detection result of the second temperature sensor meet the predetermined relationship, a detection result is generated indicating that the first and second temperature sensors are normal.

4. A block heater installation determining apparatus which is installed in a vehicle with an electric water pump for circulating engine cooling water and is configured to determine whether there has been energization of a block heater during an engine off period, comprising:

a water pump forced-operating part configured to force the electric water pump to operate if a detection result of a first temperature sensor and a detection result of a second temperature sensor or the estimation result of the temperature of the engine cooling water do not meet a predetermined relationship, under a condition where the electric water pump would not otherwise operate when the vehicle is powered up, the first temperature sensor being configured to detect a temperature of the engine cooling water and the second temperature sensor being configured to detect a temperature of another medium which is correlated with the temperature of the engine cooling water, wherein if a decrease in the temperature of the engine cooling water is observed based on the detection result of the first temperature sensor after the forced-operation of the electric water pump by the water pump forced-operating part, it is determined that there has been energization of the block heater.

5. A controller of an electric water pump for circulating engine cooling water, the controller being configured to keep the electric water pump in its deactivated state until a predetermined condition is met after an engine starts, wherein the controller is configured to force the electric water pump to operate if a relationship between a detection result of a first temperature sensor and a detection result of a second temperature sensor or the estimation result of the temperature of the engine cooling water indicates an abnormality or a possibility of an abnormality of the first or second temperature sensor, under a condition where the electric water pump would not otherwise operate when the vehicle is powered up, the first temperature sensor being configured to detect a temperature of the engine cooling water and the second temperature sensor being configured to detect a temperature of another medium which is correlated with the temperature of the engine cooling water.

* * * * *